United States Patent [19]

Nagy

[11] 4,363,452

[45] Dec. 14, 1982

[54] CENTRIFUGAL CRUSHER WITH A ROTATING GRATE HAVING GRATE BARS ADAPTING THE GRATE FOR SEPARATING THE GRIT ALSO ACCORDING TO ITS WIDTH

[75] Inventor: Egon Nagy, Budapest, Hungary

[73] Assignee: CHEMIMAS Vegyigep Tervezo es Fovallalkozo Vallalat, Budapest, Hungary

[21] Appl. No.: 243,481

[22] Filed: Mar. 13, 1981

Related U.S. Application Data

[63] Continuation of Ser. No. 76,836, Sep. 19, 1979, abandoned.

[30] Foreign Application Priority Data

Sep. 25, 1978 [HU] Hungary ..... CE 1184

[51] Int. Cl.[3] ..... B02C 17/02

[52] U.S. Cl. ..... 241/91; 241/86.1; 241/88.1; 241/88.4; 241/284

[58] Field of Search ..... 241/70, 71, 72, 73, 241/74, 85, 86.1, 86.2, 87, 88.1, 88.4, 89.2, 89.3, 91, 285 R, 275, 299, 284

[56] References Cited

U.S. PATENT DOCUMENTS

| | | | |
|---|---|---|---|
| 2,692,087 | 10/1954 | Hartshorn | 241/299 X |
| 2,901,188 | 8/1959 | Welfers et al. | 241/299 X |
| 3,845,908 | 11/1974 | Friedenreich et al. | 241/299 X |
| 4,015,783 | 4/1977 | Miller | 241/299 X |

FOREIGN PATENT DOCUMENTS 160238 9/1973 Hungary .

*Primary Examiner*—Mark Rosenbaum

[57] ABSTRACT

A centrifugal crusher having a rotor-crusher and a cylindrical grate rotatably mounted about it, wherein the grate is made up from a plurality of bars which on both sides having cam-shaped configuration such that when the bars are assembled, the adjacently lying bars form with their mating cams polygonal or circular apertures which serve as the calibrating apertures for the grit. The bars on their inwardly facing surfaces are formed at a roof-shaped angle to facilitate the material handling capacity of the grate.

3 Claims, 6 Drawing Figures

CENTRIFUGAL CRUSHER WITH A ROTATING GRATE HAVING GRATE BARS ADAPTING THE GRATE FOR SEPARATING THE GRIT ALSO ACCORDING TO ITS WIDTH

This is a continuation of application Ser. No. 76,836, filed Sept. 19, 1979, now abandoned.

FIELD OF THE INVENTION

The present invention relates to a centrifugal crusher having a rotating grating member in it in general and, more particularly, it relates to a centrifugal crusher which has a rotating grate provided with grate bars which have a special structure to achieve the separating of the grit according to a multidimensional size requirement.

BACKGROUND OF THE INVENTION

Centrifugal crushers having a rotary grate have already been well known and, one of them is illustrated in Hungarian Patent No. 160,238 which is incorporated hereinto by reference, as to the essential parts and the environment in which a rotary crusher with a rotating cylindrical grate operates. The crusher illustrated in the above-noted Patent is being used mainly to perform grating or crushing assignments in which the requirement is to produce a strictly defined upper granular size for the grit and which also should have a uniform granular structure.

It is also known that in centrifugal crushers having a rotary grate the calibrating or separation of the grit is performed by the cylindrical grate which is mounted for rotation about the striker-rotary member and, which grate, at the same time, serves also as the impact surface during the grating. This grate performs also the feeding of the material to be grated in a continuous fashion onto the striker-rotary member.

In order to satisfactorily perform the above-noted three major required functions in practical applications, grates consisting of bars turn out to be the best suitable because, in addition to their good material feeding capability, they possess also sufficient strength and rigidity. In addition, the grate bucket made up from the bars can be repaired in a simple manner and the manufacturing of the bars is relatively inexpensive and easy.

The grate bars used heretofore were similar to those used in hammer mills. They are provided with an elongated slot between the bars for purpose of separation of the grit and, the bars of such construction, were able to perform a separation only in a single dimension, namely, according to the thickness of the grit. In the case of hammer mills, or such type of crushers, this was satisfactory because the maximum size of the grit has been considerably smaller than the dimensions of the slot between the bars. However, when it came to the application of such structure to centrifugal crushers employing a rotating grate, it was found that the thickness of a large quantity of the grits will correspond to the dimensions of the slots because the striking bars hit the grits in such a manner that they are impacted onto the grate surface nearly in a vertical fashion, therefore, they can easily pass through the slots of the grate. As a result the grit will contain a large number of flat granules which have a thickness which is satisfactory, however they will have a width which is much greater than the width of the slot. Such granules can not pass through a control sieve having rectangular meshes, therefore, they become classified as excessive in dimension.

One may, therefore, conclude from the above, that the grates which have been constructed with the heretofore known bars, cannot satisfactorily meet stricter calibration requirements.

With such grates a desired upper grit size can be achieved only if the slot between the bars is set to a considerably smaller dimension than the maximum grit size. This would, however, considerably decrease the passing capacity of the grate and also would decrease the uniformity of the grit, because it would lead to an overgrating of the granules. As a result, the quantity of the fractions which are close to the dimensions of the slots would also be decreased due to the presence of the large number of flat granules.

SUMMARY OF THE INVENTION

It is, therefore, an object of the present invention to provide a rotary grate for a centrifugal crusher employing a bar construction for the grate which is capable of cablibrating or separating the grit according to a two dimensional requirement in size, namely, including the dimension of the width and, at the same time, it possesses a large passing capacity of the grit.

A basic principle of the invention rests on the recognition that in the event of a two dimensional calibration or separation of the grit, the largest calibrating or separating surface and the best passing capability can be created by apertures which have the configuration of regular polygon or circles, the latter actually representing the extreme limit of the polygon. This stems from the recognition that through a circular aperture a grit having a dimension which is similar to the diameter of the aperture can pass in any position, while in the case of a quadratic aperture it could pass only in two positions, namely in those coinciding with the two diagonals. Therefore, if the two kinds of apertures are capable of passing similar grits having the same maximum size, then the circular aperture will have a much larger probability of passing the grit than the quadratic aperture. In other words, such granule will require the more impacting onto the grate, in order to pass through it, the less diagonals the aperture is having. Consequently, in the case of centrifugal crushers having rotray grates, the inventive principle recognizes that the circular apertures should be more advantageous.

It is also recognized, that for a similar separation requirement, the diameter of the apertures in the grate having circular holes can be 1.25 times the dimension of the apertures in a grate having quadratic meshes. As a result, when the same number of holes are given, the use of circular apertures in the grate, will result in an available surface which is 22.7% greater than in the case of quadratic apertures, which again will increase the passing capacity of the grate.

In accordance with the invention, the rotary grate comprises grate bars, the both sides of which are provided with cams which limit or calibrate the width of the grit when the bars are assembled and the adjacent grate bars are abutting each other. The space between the cams correspond to the desired separating dimension and are formed as the appropriately sized half polygon or half circles on each bar when, in conjunction with the space formed in the adjacent grate bar, will result in a regular polygon or in a circle and form the sizing aperture.

In accordance with another aspect of the present invention, the aperatures are constructed with a certain taper or increasing conicity in the direction of the passing of the material in order to prevent the sticking of the separated higher sized granules in the aperature.

BRIEF DESCRIPTION OF THE DRAWINGS

The present invention will become more readily apparent from the following description of a preferred embodiment thereof shown, by way of example, in the accompanying drawings, in which.

DESCRIPTION OF THE PREFERRED EMBODIMENT

Figure 1:
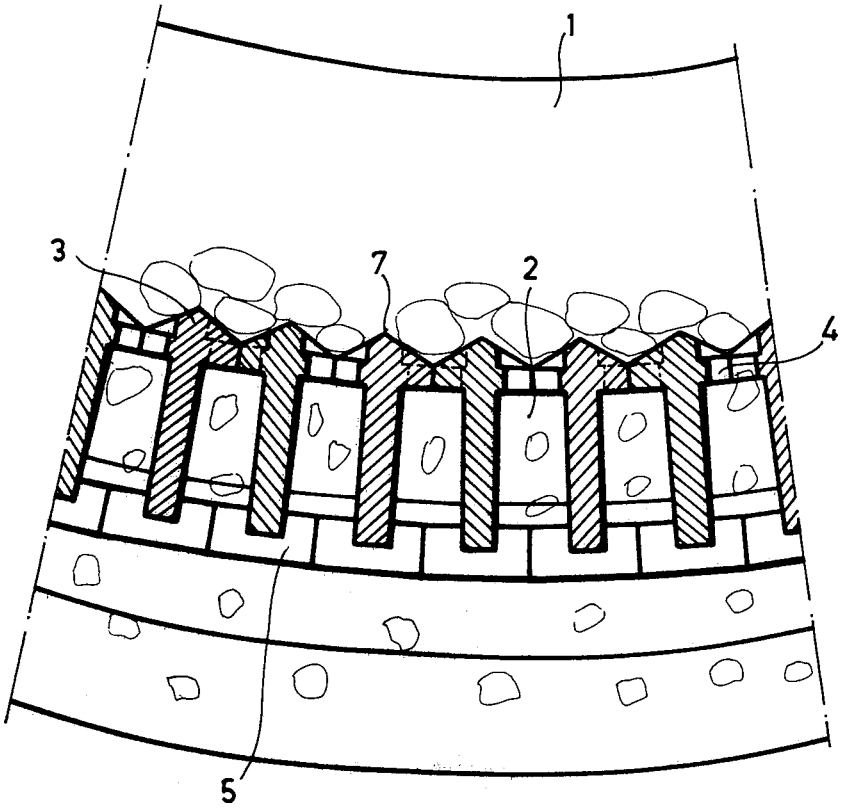
FIG. 1 is a partial sectional view of the rotatary grate for a centrifugal crusher according to the present invention provided with the calibrating or separating aperatures.
Figure 2:
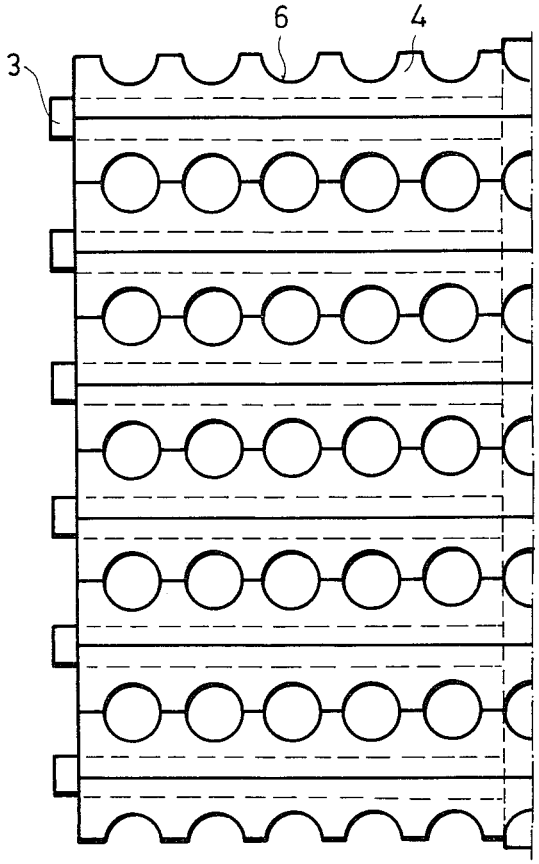
FIG. 2 illustrates the rotatary grate according to FIG. 1, on its inner surface, in a plan view.
Figure 3:
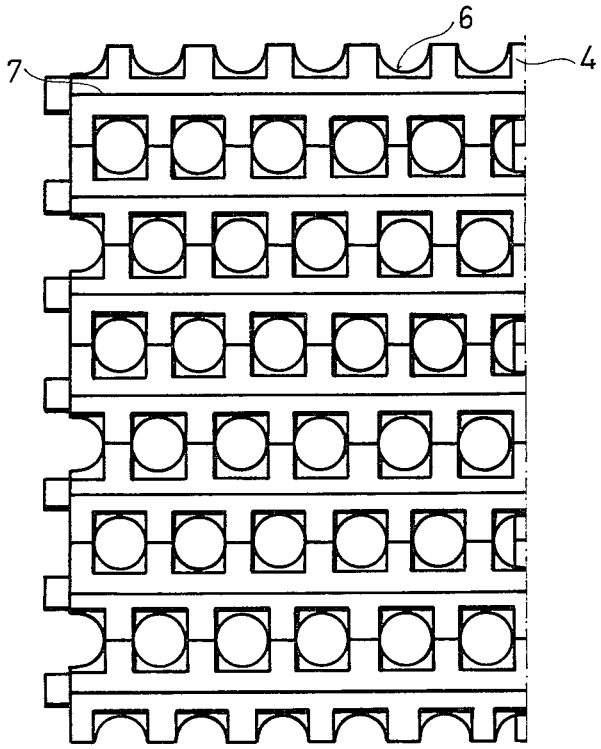
FIG. 3 is a similar illustration as FIG. 2 of the same grate, except from the upper surface thereof.
Figure 4:
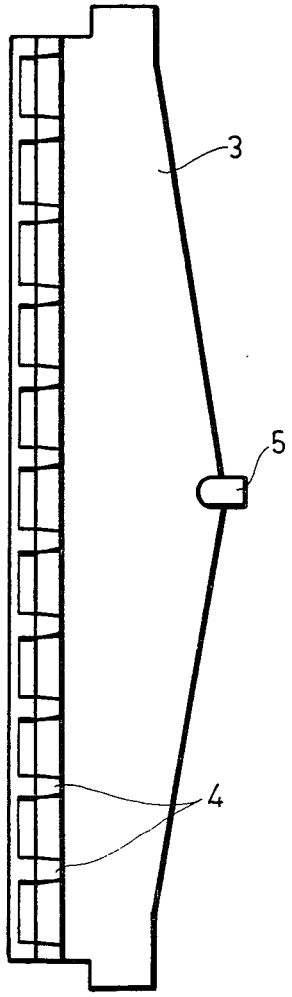
FIGS. 4 and 5 illustrate one of the grate bars in different views.
Figure 5:
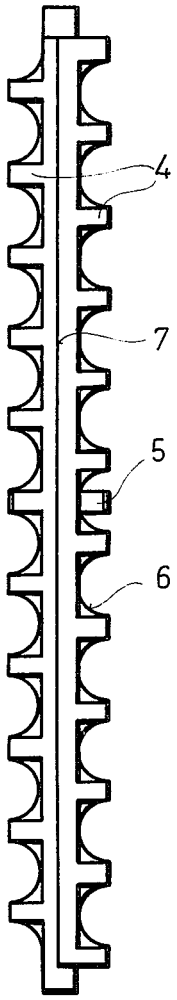

With reference to FIG. 1 it is seen that the rotary and cylindrical grate bucket 1 has on its supports 2 a plurality of grate bars 3 mounted in a continuous fashion all along its cylindrical circumference and which bars 3 are made from a high wear and abrasion resistant steel material. On both sides of the grate bars 3 cams 4 are provided which project out sideways and which as can be seen also in FIGS. 2 and 3 form in conjunction with the adjacent cams 4 of the neighboring bars, when assembled as in FIGS. 1 and 2, the calibrating apertures 6 and also serve for the spacing of the bars. The reference character 5 in FIGS. 1, 4–6 identifies a spacing cam at the lower side of each bar 3 which further enhances the alignment of the outer end portions of the bars which otherwise would be aligned and abutt only through the cams 4.

The adjacently lying cams 4 after being rounded out form the series of apertures 6 performing the calibration or separation of the grit. The apertures 6 increase outwardly in a conical fashion, that is, in the direction of the passing of the grated material in order to aid the passing of the grits therethrough.

Figure 6:
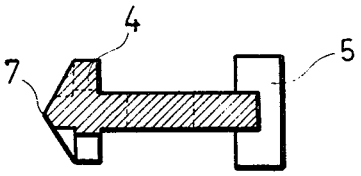
FIG. 6 illustrates in a sectional view a grate bar with a particular intention to show the roof-like top surface.

In order to increase the material feeding capability of the grate, the inner surface of the grate bars which comes into contact with the material, are formed by two planes intersecting in a roof-like fashion as can be seen in FIG. 6 and, the resulting edge 7, will increase the material feeding capacity of the grate 1.

The grate 1, according to the present invention, has its primary advantage in that it can produce a perfectly calibrated or dimensioned uniform grit with the centrifugal crusher into which the grate is built into.

It is within the scope of the present invention that the apertures 6 can be symmetrically spaced in parallel rows over the grate or offset with respect to each other. The latter situation requires the asymmetrical camming of the two sides of a single bar and mating it with a similarly cammed bar as in FIG. 5.

Further advantage of the present invention resides in that due to polygon shaped or circularly shaped apertures 6, the grits which already have the desired dimensions can quickly leave the crushing space and, consequently, they will not undergo an additional and unnecessary crushing. Despite the fact that the grate 1 according to the present invention has a large passing capacity, it still retains the strict calibrating qualities and, at the same time, it retains a very high efficiency. When the striker rotor is appropriately selected to have a certain perpherial velocity, the rotary grate according to the present invention, when used in the crusher designed accordingly, will be an excellent producer of coarse fractures or granules which are required to be produced in very large quantities.

Also the rotary grate 1 according to the present invention due to the inventive joining of the grate bars 4 will have a very rigid, strong and reliably operating, longlasting construction.

I wish to be understood that I do not desire to be limited to the exact details of construction shown and described, for obvious modifications will occur to a person skilled in the art.

Having thus described the invention, what I claim as new and desire to be secured by Letters Patent, is as follows:

1. A rotatable grate means for a centrifugal crusher apparatus, said grate means comprising a plurality of grate bars, each of said grate bars having on opposite sides thereof cam means formed thereon, said cam means having the configuration of one half of a circle, wherein means are provided on said grate bars for assemblying adjacently lying ones of said grate bars into a continuous cylindrical hollow body forming said grate means, wherein said cam means of said adjacently lying bars form a plurality of apertures, each of said apertures having a predetermined conicity, said conicity having a larger dimension lying in the direction of grit passage through said aperture, and wherein a side of said grate bars lying in the direction of grit passage through said apertures has formed thereon between adjacently lying apertures roof-shaped projections for crushing and for guiding the grit material toward the adjacently-lying apertures, each of said projections running along the substantial length of the bar, wherein said cam means are formed on one side of said bars in a predetermined geometrical relationship with the cam means on the otherside of said bars for allowing a predetermined distribution of the apertures in each row with respect to the apertures in the other row, when said bars are assembled into said grate means.

2. The grate means as claimed in claim 1, wherein said cam means are formed on said bars symmetrically.

3. The grate means as claimed in claim 1, wherein said cam means are formed on said bars offset on one side with respect to the cam means on the other side.

* * * * *